US007237774B2

(12) United States Patent
Fukatsu et al.

(10) Patent No.: US 7,237,774 B2
(45) Date of Patent: Jul. 3, 2007

(54) SHEET TREATING APPARATUS AND IMAGE FORMING APPARATUS

(75) Inventors: Masayoshi Fukatsu, Shizuoka (JP); Atsushi Ogata, Shizuoka (JP); Hironobu Ata, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 468 days.

(21) Appl. No.: 10/824,421

(22) Filed: Apr. 15, 2004

(65) Prior Publication Data

US 2004/0217543 A1 Nov. 4, 2004

(30) Foreign Application Priority Data

Apr. 30, 2003 (JP) ..... 2003-125940
Apr. 6, 2004 (JP) ..... 2004-112491

(51) Int. Cl.
*B65H 31/00* (2006.01)

(52) U.S. Cl. ..... 271/207; 270/58.07; 270/58.11; 270/58.26; 414/790.3

(58) Field of Classification Search ..... 271/207; 270/58.07, 58.08, 58.11, 58.26; 414/790.3
See application file for complete search history.

(56) References Cited

U.S. PATENT DOCUMENTS 6,302,606 B1 10/2001 Hayakawa et al. ..... 400/625
6,318,718 B1 11/2001 Ogata et al. ..... 271/213
6,325,371 B1 12/2001 Araki et al. ..... 271/297
6,328,299 B1 * 12/2001 Coombs ..... 270/58.08
6,382,616 B1 5/2002 Waragai et al. ..... 270/58.12
2003/0006547 A1 * 1/2003 Lee ..... 271/189
2003/0185612 A1 10/2003 Sekiyama et al. ..... 399/405
2004/0022567 A1 2/2004 Fukatsu et al. ..... 399/405

FOREIGN PATENT DOCUMENTS

JP 2003-73014 3/2003

* cited by examiner

*Primary Examiner*—David H. Bollinger
(74) *Attorney, Agent, or Firm*—Fitzpatrick, Cella, Harper & Scinto

(57) ABSTRACT

The trailing edge of a sheet delivered to a treating tray for treating the sheet with respect to a delivering direction is made to abut against a trailing edge regulating member to thereby regulate the trailing edge position of the sheet. Next, a sheet delivery lever is reciprocally moved between a first position in which it is retracted to the upstream side of the trailing edge regulating member with respect to the sheet delivering direction and a second position in which it protrudes into the stacking area of the treating tray, to thereby push the trailing edge of the treated sheet and deliver the sheet onto a sheet stacking tray. Also, when this sheet delivery lever is to be moved from the second position to the first position, the sheet delivery lever is moved so as to be capable of passing by the sheet delivered to the treating tray, whereby even during the time when the sheet delivering lever is moved to the first position, the delivery of a succeeding sheet to the treating tray is made possible.

14 Claims, 10 Drawing Sheets

SHEET TREATING APPARATUS AND IMAGE FORMING APPARATUS

BACKGROUND OF THE INVENTION

1. Field of the Invention

The invention relates to a sheet treating apparatus and an image forming apparatus which can prevent any reduction in throughput and which are low in cost, and particularly to delivering means for delivering a sheet after delivered to a treating tray and treated to sheet stacking means.

2. Description of Related Art

Some of conventional image forming apparatus are provided a sheet treating apparatus for treating a sheet having an image formed thereon. This sheet treating apparatus is provided with a sheet delivering apparatus for once delivering the sheet having an image formed thereon to a treating tray and effecting treatments such as alignment and stapling, and thereafter delivering the sheet (bundle) to a stacking tray.

Now, in such a sheet treating apparatus, as sheet delivering means for delivering a sheet bundle aligned and treated by the treating tray to the stacking tray, there are known sheet delivery rollers and a sheet delivery belt provided with a sheet delivery claw (for example, Japanese Patent Application Laid-Open No. 2003-73014).

FIG. 11 of the accompanying drawings illustrates the delivery by such a conventional sheet delivery belt provided with a sheet delivery claw, and in FIG. 11, the reference numeral 504 designates an intermediate stacking portion constituting the treating tray, the reference numeral 500 denotes a sheet delivery belt, and the reference numeral 501 designates a sheet delivery claw provided on the sheet delivery belt 500. Also, the reference numeral 502 denotes a sheet delivered by the sheet delivery claw 501 with the rotation of the sheet delivery belt 500 and this sheet 502 is pushed out by the sheet delivery claw 501, and thereafter falls onto and is stacked on a stacking tray 503.

The sheet delivery claw 501 is normally in a position indicated by A in FIG. 11 in which it is retracted below the intermediate stacking portion 500, and is moved from the position indicated by A to positions B, C, D, E, F, G, H and I when the sheet 502 is to be delivered, thereby delivering the sheet 502. After it has thus delivered the sheet 502, the sheet delivery claw is adapted to be again returned to the position A.

However, in the conventional sheet treating apparatus adapted to deliver the sheet 502 by such a sheet delivery claw 501, the sheet delivery claw 501 protrudes to above the stacking tray 503, for example, in the positions indicated by G and H, until it is moved to below the intermediate stacking portion 500 after it has delivered the sheet 502 in a position indicated by F. That is, the sheet delivery claw 501 is adapted to be retracted to below the intermediate stacking portion 500 while being moved above the stacking tray 503 after it has delivered the sheet 502.

When the sheet delivery claw 501 is thus retracted while being moved above the stacking tray 503, the maximum stack height of sheets which can be stacked on the stacking tray 503 has been limited to such a height that the retracted sheet delivery claw 501 does not contact with the sheets on the stacking tray, that is, to below the passage area of the sheet delivery claw 501.

That is, in a method of causing the sheet delivery claw 501 to make one round by such a sheet delivery belt 500 to thereby deliver the sheet, a space for the sheet delivery claw 501 to be moved therein must be secured above the stacking tray and correspondingly, the stack upper limit height has been low. Also, there has been the problem that the cost of the parts of the sheet delivery belt itself is high and the cost of the apparatus becomes high.

To solve such a problem, for example, the sheet delivery claw 501 can be designed to be reciprocally moved, instead of being caused to make one round. However, in a case where the sheet delivery claw 501 is thus designed to be reciprocally moved, the sheet delivery claw 501 contacts with a sheet next delivered to the intermediate stacking portion 500 when the sheet delivery claw 501 is returned to its original position after it has delivered a sheet.

Thereafter, when the sheet delivery claw 501 is to be returned to its original position, the sheet must be stopped, and in a case where design is made such that the sheet is thus stopped each time the sheet delivery claw 501 is returned to its original position, there arises another problem that throughput is reduced.

Also, in a conventional sheet treating apparatus wherein the stacking tray is provided for upward and downward movement, the stacking tray is once moved down in order to secure a space for the movement of the sheet delivery claw 501, and is again moved up to a proper sheet stacking position after the sheet delivery claw 501 has been returned to its original position. Therefore, the sheet stacking capacity need not be decreased, but yet the next sheet must be stopped until the stacking tray is returned to the proper sheet stacking position, and this has led to the problem that throughput is reduced and structure becomes complicated and costly.

On the other hand, in a method of delivering a sheet by a sheet delivery rollers, it is unnecessary to secure a space for the sheet delivery roller 501 to be move therein above the stacking tray and therefore, the stack upper limit height can be made great, but when sheets are to be stacked on the intermediate stacking portion 504 or when the sheets stacked on the intermediate stacking portion 504 are to be aligned, it is necessary to release the nip and therefore, discretely from the rotative driving of the roller, a drive source and a mechanism for releasing the nip are necessary, and this has led to the problem of a higher cost.

SUMMARY OF THE INVENTION

So, the present invention has been made in view of such a situation and an object thereof is to provide a sheet treating apparatus and an image forming apparatus which can prevent any reduction in throughput and is low in cost.

Another object of the present invention is to provide a sheet treating apparatus for delivering a sheet to a treating tray and treating it, and thereafter delivering the treated sheet onto sheet stacking means, provided with a trailing edge regulating member for contacting with the trailing edge of the sheet delivered to the treating tray with respect to the delivery direction of the sheet, and regulating the trailing edge position of the sheet, and delivering means reciprocally movable between a first position in which it is retracted to the upstream side of the trailing edge regulating member with respect to the sheet delivery direction and a second position in which it protrudes into the stacking area of the treating tray, and adapted to push the trailing edge of the sheet on the treating tray to thereby deliver the treated sheet onto the sheet stacking means, wherein when the delivering means is to be moved from the second position to the first position, the delivering means is adapted to be moved so as to be capable of passing by the sheet delivered to the treating tray.

The upper surface of the delivering means may preferably constitute a guide surface for guiding the sheet delivered to the treating tray.

The sheet treating apparatus may preferably be provided with a transporting path for transporting the sheet to the treating tray, and the upper surface of the delivering means may preferably have a shape moving substantially in parallelism to the transporting path.

Another object of the present invention is to provide an image forming apparatus provided with an image forming portion and the above-described sheet treating apparatus.

As described above, design is made such that as in the present embodiment, when the delivering means is to be moved from the second position in which it protrudes into the stacking area of the treating tray to the first position in which it is retracted outwardly of the trailing edge regulating member side of the treating tray, the delivering means can be moved while passing by the sheet delivered next onto the treating tray, whereby any reduction in throughput can be prevented at a low cost.

DETAILED DESCRIPTION OF THE PREFERRED EMBODIMENTS

Some embodiments of the present invention will hereinafter be described in detail with reference to the drawings.

Figure 1:
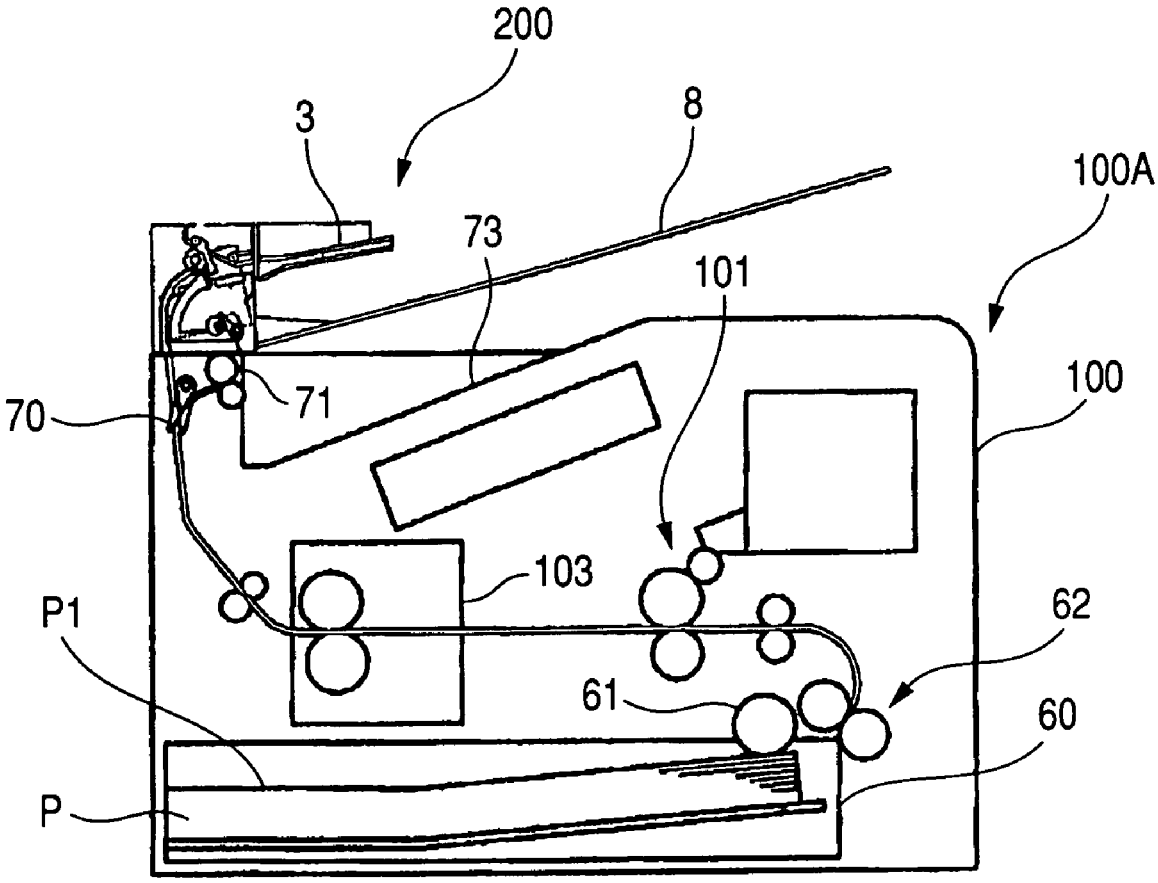
FIG. 1 is a schematic cross-sectional view showing the general construction of a laser beam printer which is an example of an image forming apparatus provided with a sheet treating apparatus according to a first embodiment of the present invention.

FIG. 1 is a schematic cross-sectional view showing the general construction of a laser beam printer which is an example of an image forming apparatus provided with a sheet treating apparatus according to a first embodiment of the present invention.

In FIG. 1, the reference character 100A designates the laser beam printer, and the reference numeral 100 denotes a laser beam printer main body (hereinafter referred to as the printer main body), and the laser beam printer 100A is singly connected to a computer or a network such as LAN, and is adapted to form an image on a sheet by a predetermined image forming process on the basis of image information, a print signal or the like sent from the computer or the network, and delivers the sheet.

Also, the reference numeral 200 designates the sheet treating apparatus and this sheet treating apparatus 200 is disposed above the printer main body 100 and is adapted place a sheet delivered out of the printer main body 100 on a treating tray 3 in a face-down state in which the image bearing surface of the sheet faces down, and thereafter effect alignment, bundle sheets in each predetermined job and staple the sheets at a location or a plurality of locations of the sheet, and deliver and stack the sheets onto a stacking tray 8 which is sheet stacking means, or deliver and stack the sheets delivered out of the printer main body 100 onto the stacking tray 8 simply in the face-down state.

The construction of each portion of the printer main body 100 will now be described along the transport route of the sheet P being transported.

The printer main body 100 is provided with a feeding cassette 50 in which a plurality of sheets P are stacked, and the uppermost one P1 of the sheets stacked in this feeding cassette 60 is adapted to be separated and fed by a feeding roller 61 and a pair of retard rollers 62. The uppermost sheet P1 is fed from the feeding cassette 60 by a predetermined print signal supplied from the computer or the network, and a toner image is first transferred to the upper surface of this sheet P1 in an image forming portion 101 for forming a toner image by an image forming process of a so-called laser beam type, and subsequently heat and pressure are applied to the sheet P1 by a fixing device 103 on a downstream side, whereby the toner image is permanently fixed.

Next, the sheet P1 on which the toner image has been fixed is adapted to be selectively delivered to a sheet delivery tray 73 which is a face-down (FD) delivery portion provided in the upper portion of the printer main body 100 or to the sheet treating apparatus side, for example, by delivery rollers 71 in conformity with the position of a flapper 70 pivotally moved on the basis of a control signal from a control portion, not shown.

Figure 2:
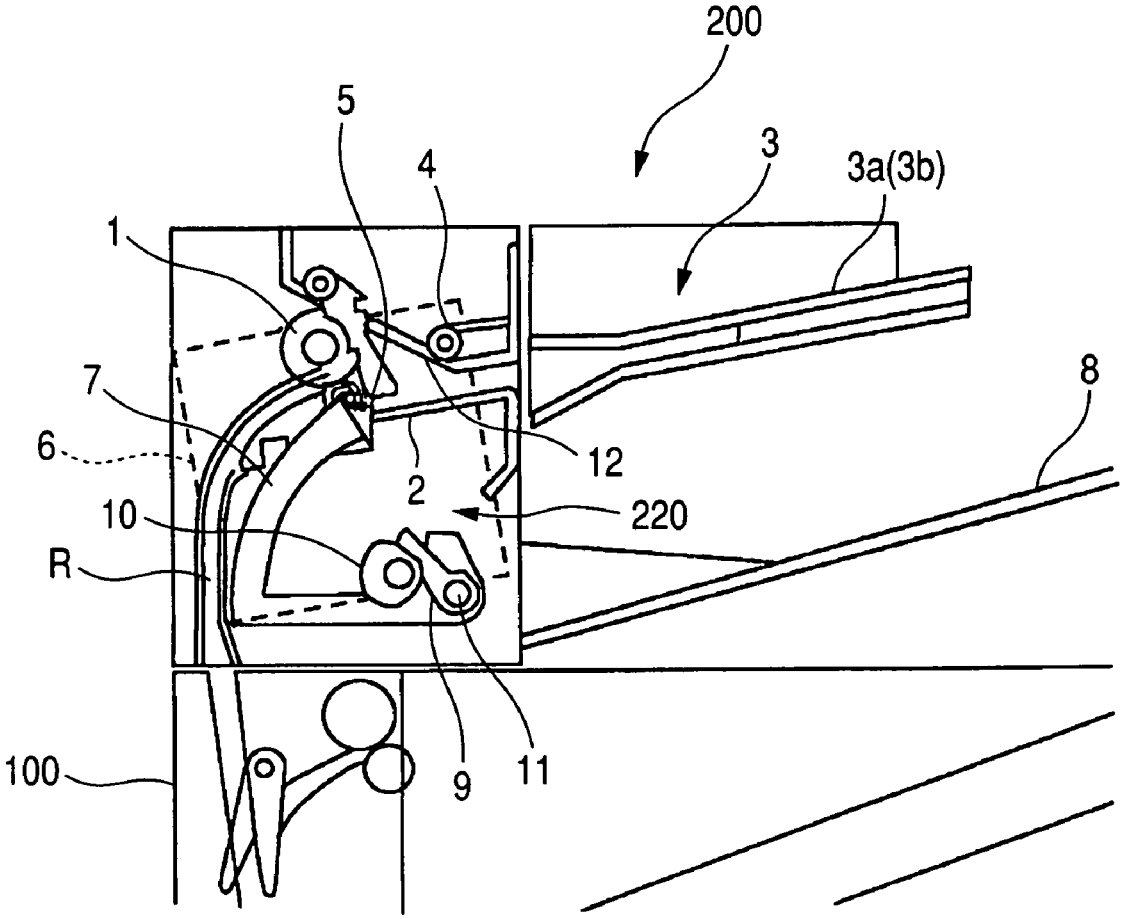
FIG. 2 illustrates the construction of the sheet treating apparatus.

Now, the sheet treating apparatus 200 as shown in FIG. 2, is provided with a sheet delivering apparatus 220 having, besides an intermediate roller 1 for delivering the sheet P1 to the treating tray 3, for example, a sheet delivery lever 7 which is delivering means for delivering a sheet bundle delivered to the treating tray 3, and thereafter subjected to a treatment such as stapling.

Figure 3:
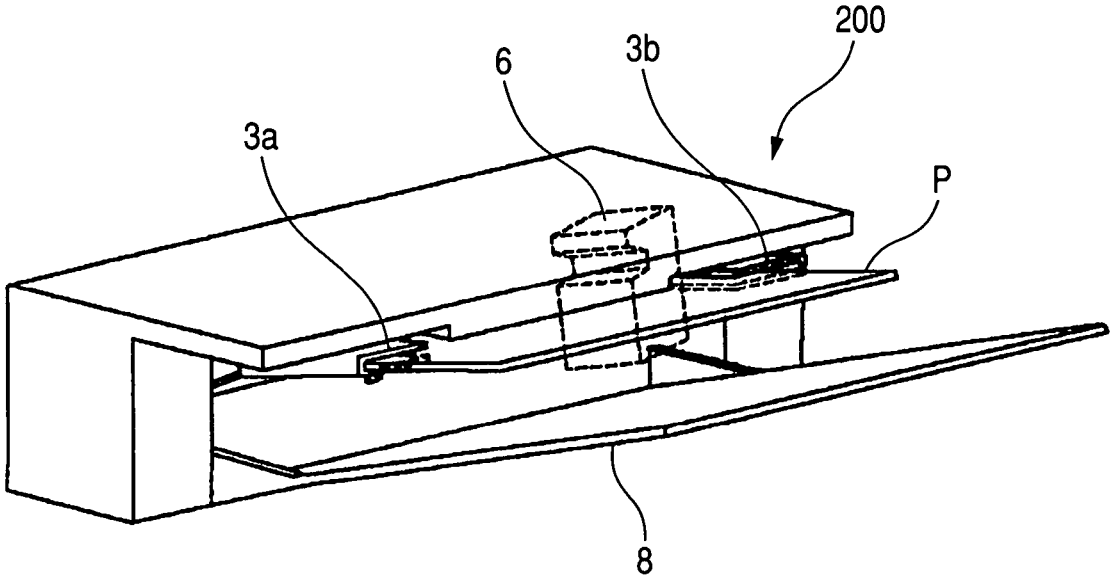
FIG. 3 is a perspective view of the sheet treating apparatus.

The treating tray 3 is comprised of an intermediate stacking portion 2, a leftwardly laterally aligning member 3*a* for temporarily stacking the sheet P shown in FIG. 3, and holding down one side edge (the left side as viewed in FIG. 3) of the sheet P, and a rightwardly laterally aligning member 3*b* for likewise temporarily stacking the sheet P, and holding down the other side edge (the right side as viewed in FIG. 3) of the sheet P.

The leftwardly laterally aligning member 3*a* is adapted to be moved to one of a retracted position in which the inner end portion of a surface stacking the sheet P thereon is outside the width of the sheet, a waiting position in which the inner end portion of the surface stacking the sheet P thereon is inside the width of the sheet and a surface for holding down a side edge of the sheet P is a predetermined amount outside the width of the sheet, an aligning position in which a side edge of the sheet P is held down, and an alignment releasing position, and the rightwardly laterally aligning member 3*b* is adapted to be moved to the retracted position or the waiting position, and when an aligning operation is to be performed, only the leftwardly laterally aligning member 3*a* is adapted to be moved in accordance with the size of the sheet.

The leftwardly laterally aligning member 3*a* and the rightwardly laterally aligning member 3*b*, when in the waiting position, come to constitute a portion of the treating tray 3 for holding the sheet P1 delivered by the intermediate roller 1. Also, when the leftwardly laterally aligning member 3*a* and the rightwardly laterally aligning member 3*b* are moved from the waiting position to the retracted position in which the holding of the sheet is released, bundle delivery which will be described later becomes possible.

Further, after the sheet P has been held by the leftwardly laterally aligning member 3*a* and the rightwardly laterally aligning member 3*b* which are in the waiting position, the leftwardly laterally aligning member 3*a* is moved to the aligning position, whereby the side edge of the sheet is aligned, and when the leftwardly laterally aligning member 3*a* is moved to a lateral alignment releasing position after the side edge of the sheet P has been aligned, the pressure contact of the leftwardly laterally aligning member 3*a* and the rightwardly laterally aligning member 3*b* with the sheet P is released.

The leftwardly laterally aligning member 3*a* and the rightwardly laterally aligning member 3*b* have their downstream sides with respect to a sheet delivering direction inclined higher by a predetermined angle and therefore, when the pressure contact of the leftwardly laterally aligning member 3*a* and the rightwardly laterally aligning member 3*b* with the sheet P is released, the sheet P is moved toward the intermediate roller side by gravity or a paddle 4 shown in FIG. 2 and comes into contact with a reference wall (a rear end wall) 5 which is a trailing edge regulating member, whereby the trailing edge of the sheet P is regulated.

Also, in FIGS. 2 and 3, the reference numeral 6 designates a stapler unit which is an example of treating means, and this stapler unit 6 is adapted to effect stapling treatment on the basis of a command outputted in advance from a host computer or the like. This stapler unit 6 is disposed outside a sheet transport range.

When in the sheet treating apparatus 200 constructed as described above, the sheet P1 is transported in, the sheet P1 is transported by the intermediate roller 1. At this time, the leftwardly laterally aligning member 3*a* and the rightwardly laterally aligning member 3*b* are in the waiting position and thus, the sheet P1 transported and delivered by the intermediate roller 1 is held by the leftwardly laterally aligning member 3*a* and the rightwardly laterally aligning member 3*b*.

Next, the leftwardly laterally aligning member 3*a* is moved to an aligning position, whereby a widthwise aligning operation for the sheet P1 is started. After such widthwise alignment has been effected, the leftwardly laterally aligning member 3*a* is moved to an alignment releasing position, and the sheet P1 is rammed against the reference wall 5 by gravity and the paddle 4 and is aligned.

After such an aligning operation, the leftwardly laterally aligning member 3*a* is moved to the waiting position so as to be capable of coping with the delivery of the next sheet. Also, design is made such that at this time, the aligned sheet is pressed from the upper surface thereof by presser means, not shown, whereby the pushing of the preceding sheet by the succeeding sheet is prevented, and the intermediate stacking of the first sheet is terminated.

Next, such an operation is performed repetitively, and the aligning operation for the last (nth) sheet in one job is performed, whereafter an end portion of a sheet bundle is stapled by the stapler unit 6. When the stapling operation is terminated in this manner, the leftwardly laterally aligning member 3*a* and the rightwardly laterally aligning member 3*b* are moved to the retracted position and also, the sheet bundle is pushed out by a sheet delivery lever 7, whereby the sheet bundle is delivered to the stacking tray 8.

Now, the sheet delivering apparatus 220 of the sheet treating apparatus 200 which delivers the sheet bundle to the stacking tray 8 as described above, as shown in FIG. 2, is provided with a sheet delivery lever driving portion provided with the sheet delivery lever 7, and is addition, a cam lever 9 pivotally moved with the sheet delivery lever 7 with a shaft 11 as a fulcrum, and a cam roller 10 which is cam means brought into pressure contact with the cam lever 9.

The cam roller 10 stops rotating each time it makes a half round by drive controlling means, not shown, and also is of such a shape that when the cam roller 10 makes a half round, the cam lever 9 effects reciprocal movement within a range of 0 degree to 45 degrees. By the cam lever 9 thus effecting reciprocal movement within the range of 0 degree to 45 degrees, the sheet delivery lever 7 also effects reciprocal movement.

The reference numeral 12 denotes the upper guide of an intermediate stacking portion 2, and at a location whereat this upper guide 12 intersects with the movement route of the sheet delivery lever 7, a cut-away or a rib, not shown, is formed so that the reciprocal movement of he sheet delivery lever 7 may be possible. Also, the letter R designates a curved transport path, and the intermediate roller 1 is provided at an end portion of this transport path R.

Description will now be made of the sheet delivering operation of the sheet delivering apparatus 220 constructed as described above.

Figure 4A:
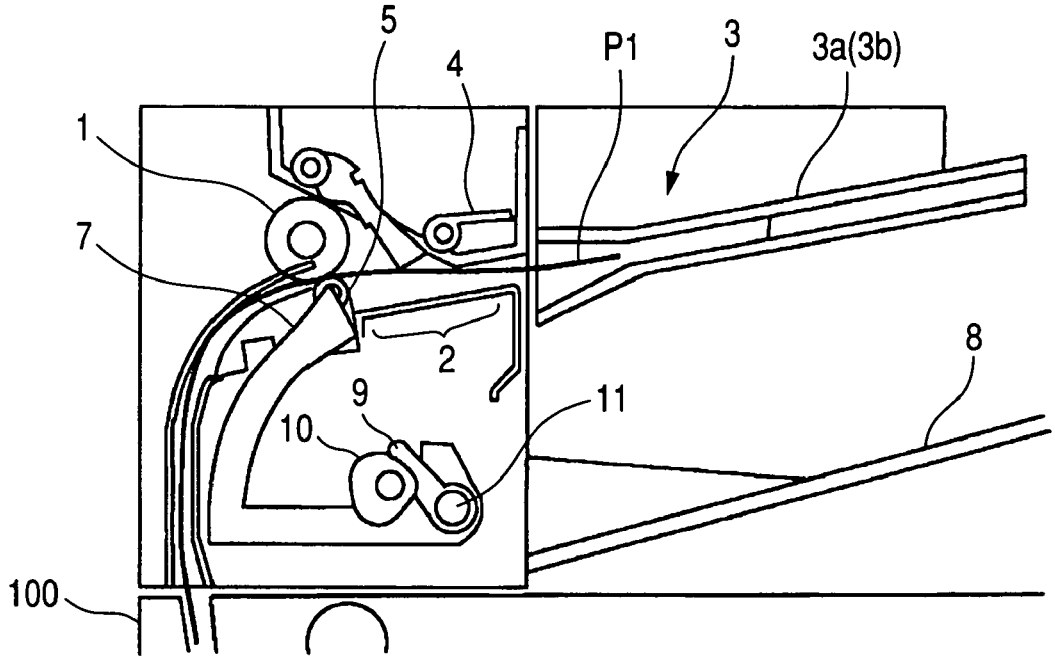
FIGS. 4A and 4B are first views illustrating the sheet delivering operation of the sheet treating apparatus.
Figure 5A:
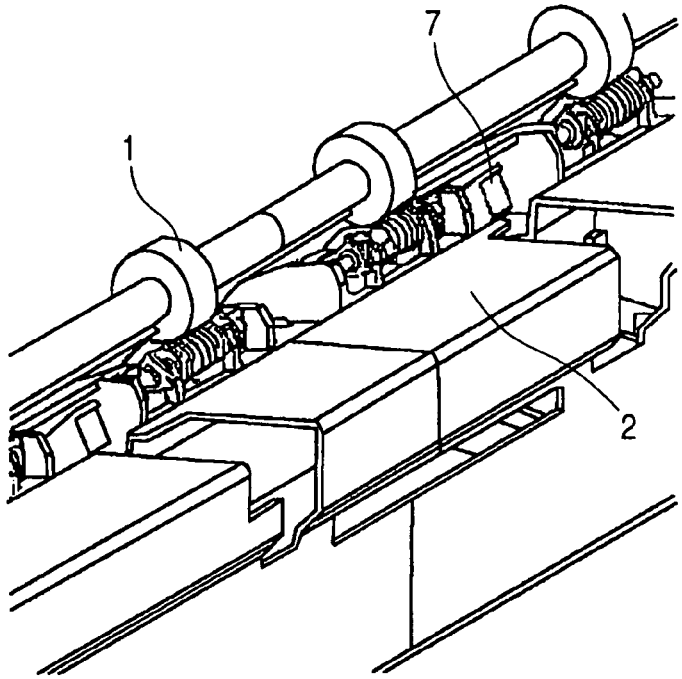
FIGS. 5A and 5B are first perspective views illustrating the sheet delivering operation of the sheet treating apparatus.

FIG. 4A shows a state in which the leading edge of the sheet P1 fed in from the printer main body 100 has passed the intermediate roller 1 and has been transported to the leftwardly laterally aligning member 3*a* and the rightwardly laterally aligning member 3*b*. In this state, the sheet delivery lever 7, as shown in FIGS. 4A and 5A, is retracted to a first position which is an initial position on the upstream side of the reference wall 5 so as not to interfere with the sheet P1 transported thereto.

Figure 4B:
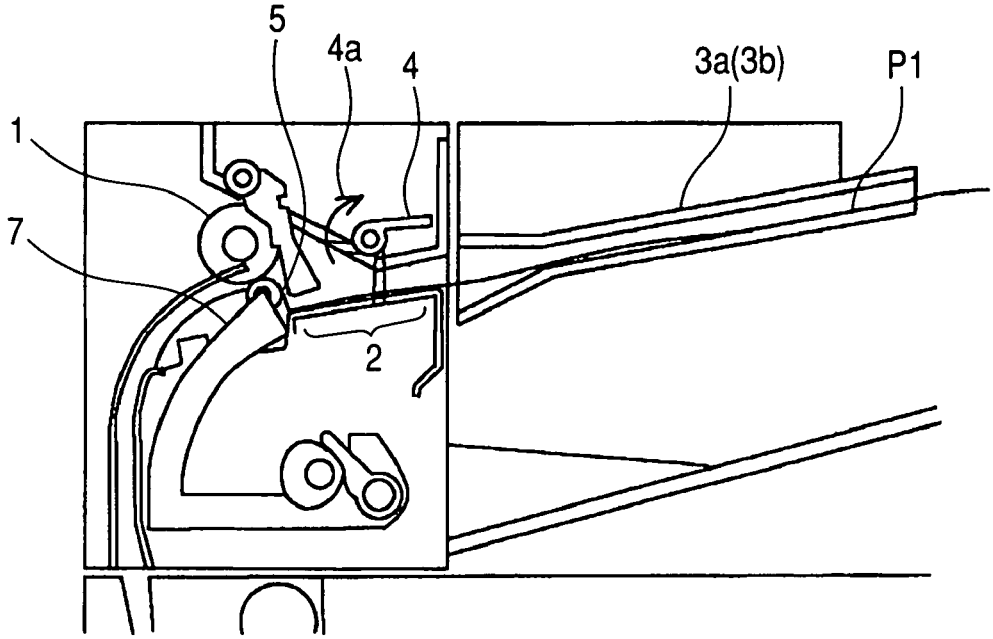

Also, FIG. 4B shows a state in which the trailing edge of the sheet P1 has passed the intermediate roller 1 and has fallen to the intermediate stacking portion 2. Thereafter, the trailing edge of this sheet P1 is rammed against the reference wall 5 by the paddle 4 being rotated in a direction indicated by arrow 4*a*, and alignment in the delivering direction is effected.

Further, thereafter, alignment in the widthwise direction of the sheet orthogonal to the delivering direction is effected by the leftwardly laterally aligning member 3*a* and the rightwardly laterally aligning member 3*b*, and lastly, sheet presser means, not shown, presses the sheet P1, whereby the intermediate stacking of the sheet P1 is terminated. This operation is repeated for a predetermined number of sheets, whereafter in the case of a staple mode, an end portion of the sheet bundle is stapled by the stapler unit 6.

Figure 5B:
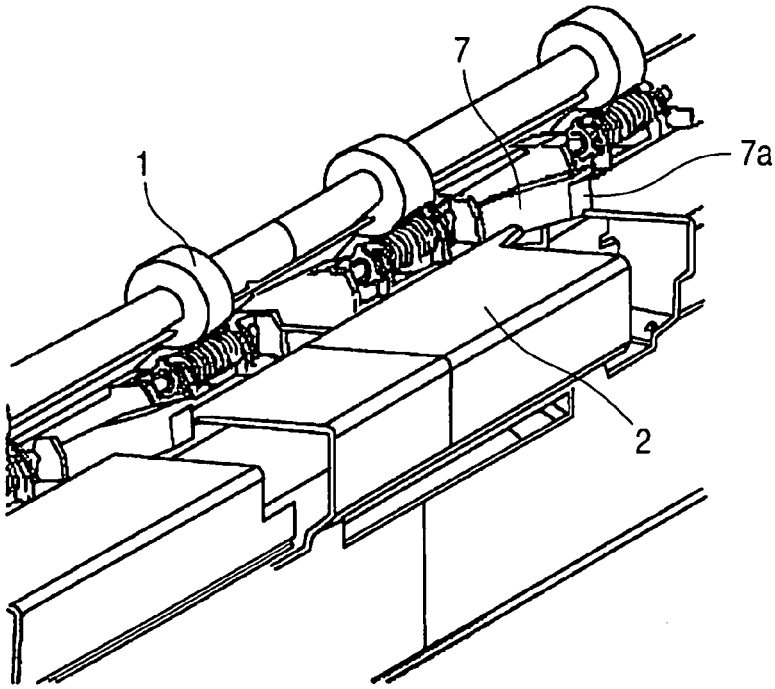
Figure 6A:
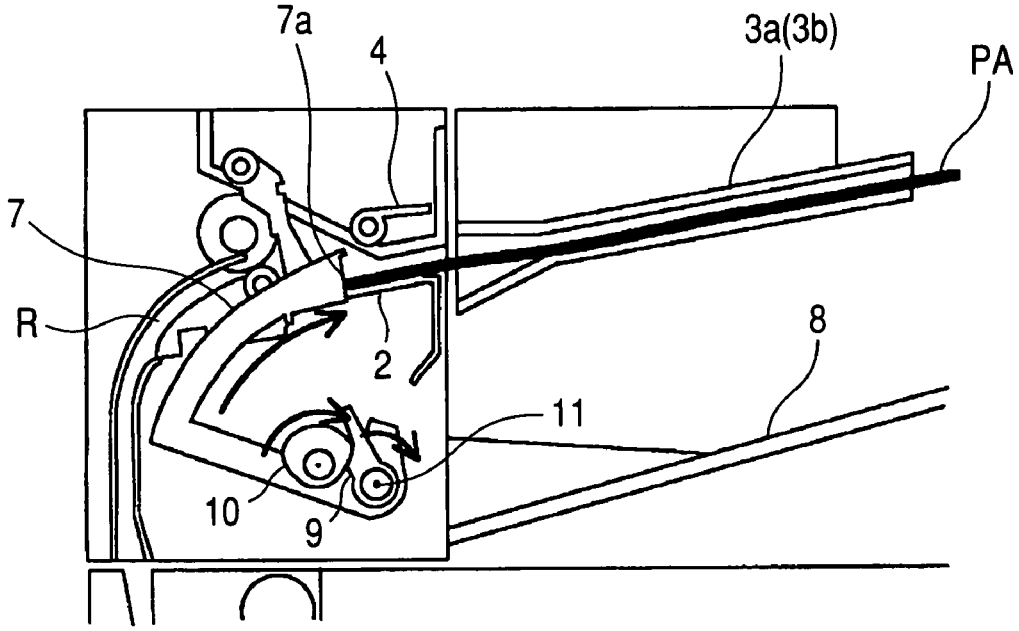
FIGS. 6A and 6B are second views illustrating the sheet delivering operation of the sheet treating apparatus.

Next, after the stapling of the sheet bundle has been effected as described above, the cam roller 10 is rotated by about 20 degrees in a clockwise direction, as shown in 6A, whereby the cam lever 9 and the sheet delivery lever 7 are rotated in the clockwise direction, and therewith, as shown in FIGS. 5B and 6A, the downstream end 7*a* of the sheet delivery lever 7 juts out from the reference wall 5 and presses the trailing edge of the sheet bundle PA on the intermediate stacking portion.

Figure 6B:
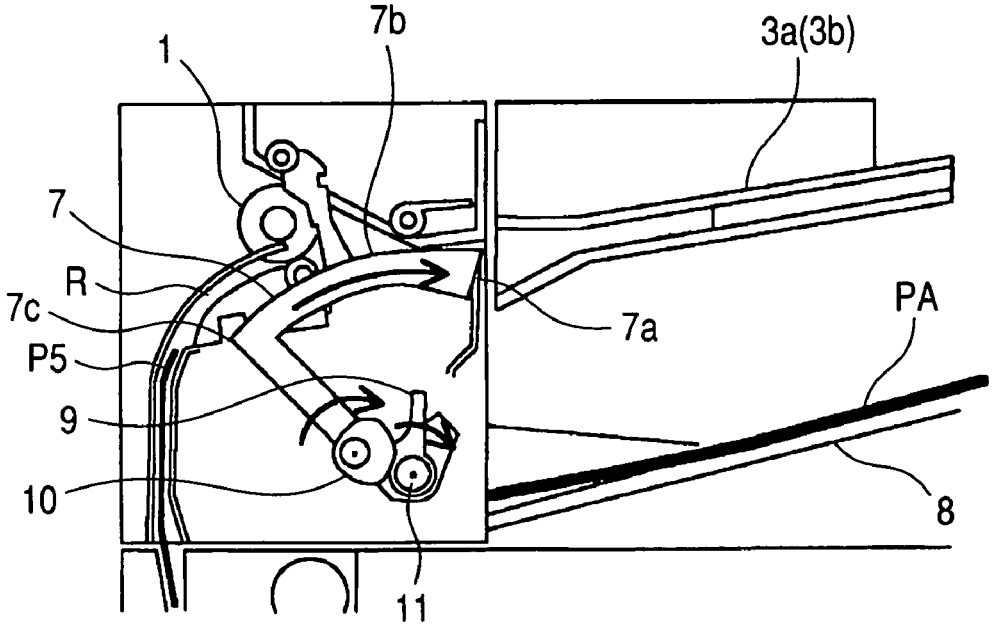
Figure 7:
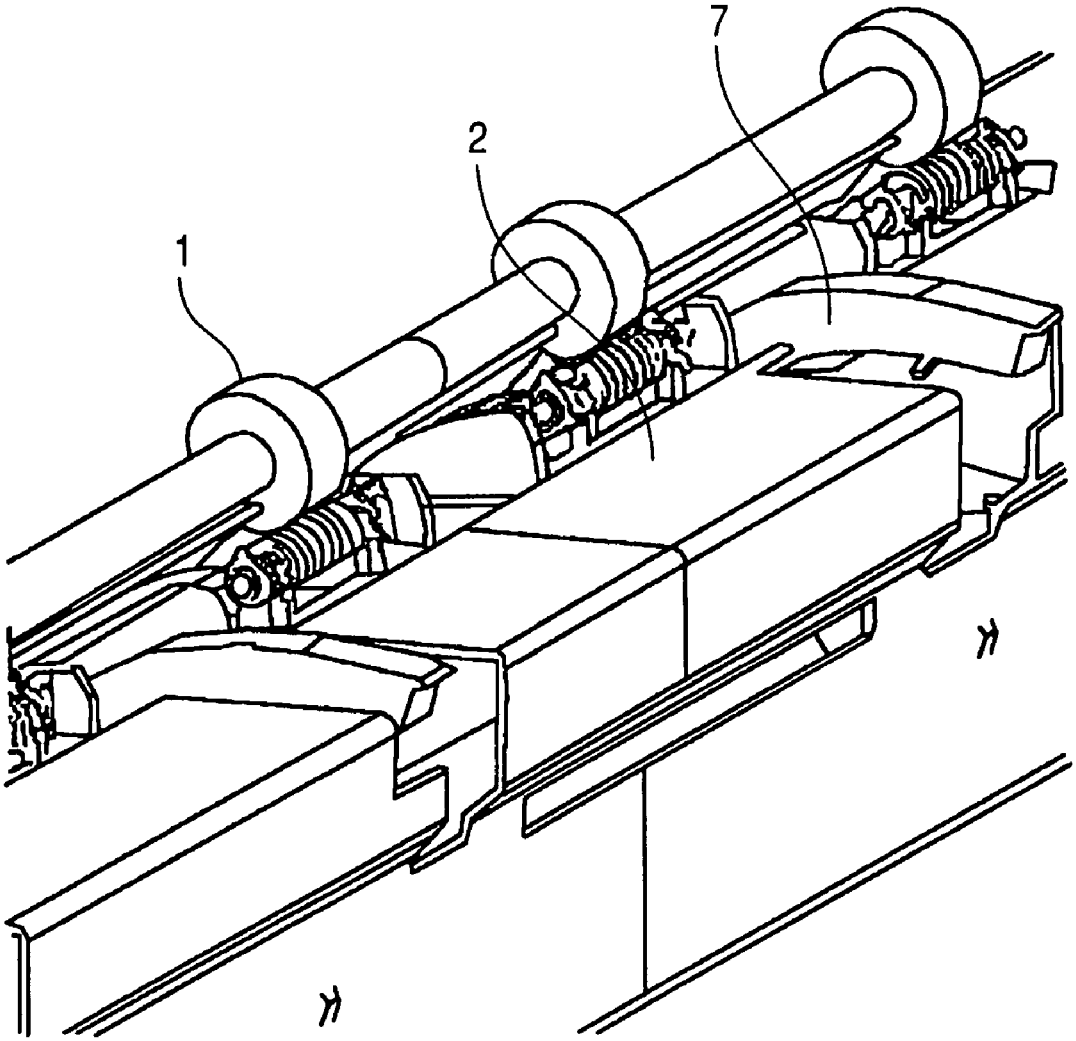
FIG. 7 is a second perspective view illustrating the sheet delivering operation of the sheet treating apparatus.

Further, thereafter, the cam roller 10 is rotated by about 20 degrees in the clockwise direction, whereupon the downstream end 7*a* of the sheet delivery lever 7 is moved to the downstream end of the intermediate stacking portion 2, as shown in FIGS. 6B and 7, whereby the sheet bundle PA falls and is stacked on the stacking tray 8. After the sheet bundle PA is thus made to fall, the cam roller 10 is once stopped, and therewith, the cam lever 9 and the sheet delivery lever 7 are also rotated by about 45 degrees from the first position and are once stopped in a second position for delivering the sheet. The angles of rotation shown in the present embodiment are merely examples, and are suitably determined by such a factor as the size of the sheet.

In the present embodiment, in a state in which the sheet bundle PA has been thus delivered and the levers have been stopped, the upstream end 7*c* of the sheet delivery lever 7 remains retracted to the upstream side of the reference wall 5, as shown in FIG. 6B. Also, the upper surface 7*b* of the sheet delivery lever 7 is formed into an arcuate shape centering on a shaft 11 and substantially parallel to the curved transport path R.

Now, in FIG. 6B, a preceding sheet P5 in the next job has approached the upstream side of the intermediate roller 1. Thereafter, in this state, the cam roller 10 resumes its rotation, and when it is reversely rotated, the cam lever 9 and the sheet delivery lever 7 are moved toward the first position by the shape of the cam roller 10, as shown in FIG. 8.

Figure 8:
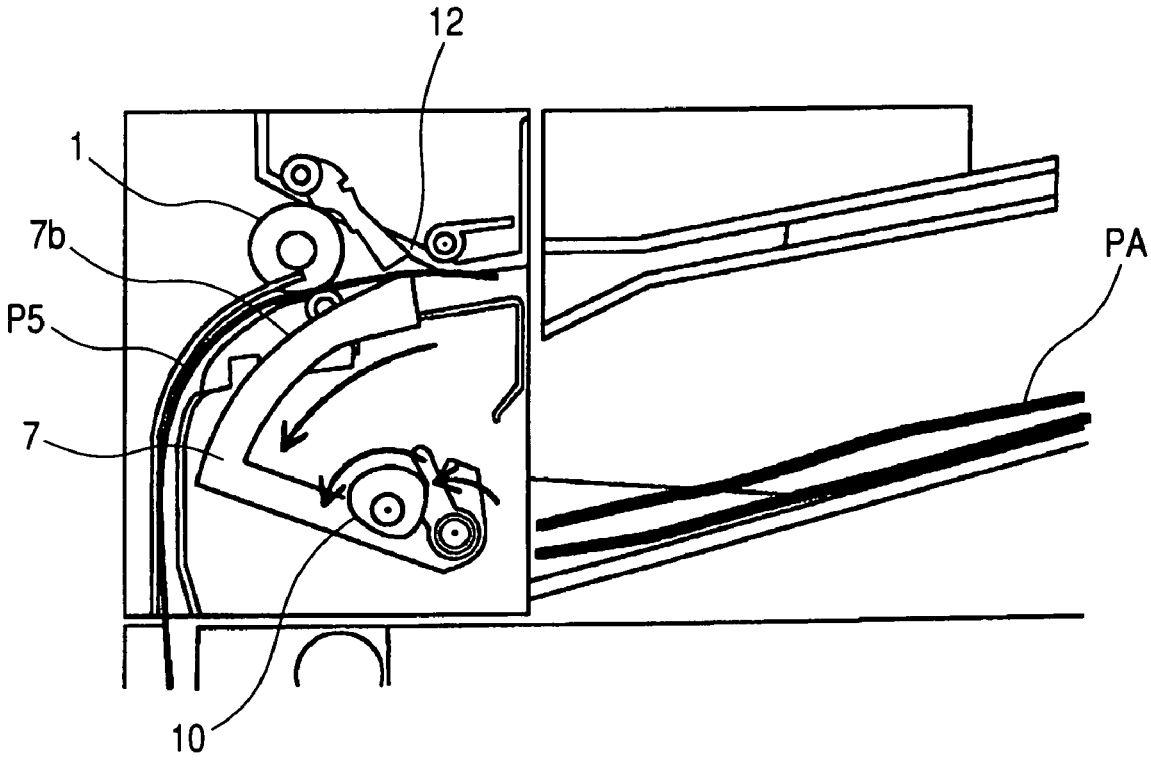
FIG. 8 is a third view illustrating the sheet delivering operation of the sheet treating apparatus.

Here, as shown in FIG. 8, the leading edge of the succeeding sheet P5 has already passed the intermediate roller 1, but as already described, the upper surface 7*b* of the sheet delivery lever 7 has an arcuate shape substantially parallel to the transport path R, and by the upper surface 7*b* of the sheet delivery lever 7 being formed as described above, the upper surface 7*b* of the sheet delivery lever 7 is positioned substantially on the extension of the transport path R when it protrudes from the reference wall 5, whereby the upper surface 7*b* of the sheet delivery lever 7 can perform the role of a transport guide for guiding the underside of the sheet P5 transported thereto.

Also, when the sheet delivery lever 7 is thus moved, the upstream end 7*c* of the sheet delivery lever 7 remains retracted to the upstream side of the reference wall 5, as shown in FIG. 6B and therefore, the sheet delivery lever 7 can pass by the succeeding sheet P5 without contacting with the succeeding sheet P5, and does not hamper the transport of the succeeding sheet P5.

That is, in the present embodiment, the sheet delivery lever 7 delivers the sheet bundle as shown in FIG. 6B, and thereafter is reversely rotated and returns to the first position, as shown in FIG. 8, and therefore, after it has delivered the sheet bundle, the sheet delivery lever 7 does not protrude to the intermediate stacking portion 2. Therefore, it does not contact with the sheet bundle stacked on the intermediate stacking portion 2.

Thereafter, the cam roller 10 is rotated to the initial position, and the sheet delivery lever 7 is also returned to and stopped in the position of FIGS. 4A and 4B, i.e., the first position, and can receive the head sheet in the next job.

By the sheet delivery lever 7 being thus reciprocally moved between the first position and the second position, the treated sheet can be delivered onto the stacking tray and also, the sheet delivery lever does not pass above the stacked sheets when it is returned to the first position and therefore, the sheet stack upper limit height can be made great.

Also, in the second position, the rear end (the upstream end 7*c*) remains in the reference wall, whereby when it is moved from the second position to the first position, the sheet delivery lever 7 can be moved past the sheet delivered next to the intermediate stacking portion 2. Thereby, even when the sheet delivery lever 7 is moved to the first position, the succeeding sheet can be delivered to the treating tray 3 without being stopped, and any reduction in the throughput between jobs or between the sheets can be prevented by an inexpensive construction.

In the description hitherto made, design is made such that in the second position, the upstream end 7*c* of the sheet delivery lever 7 remains on the upstream side of the reference wall, but if the sheet delivery lever 7 can be moved past a sheet delivered next, the position of the end portion of the upstream side of the sheet delivery lever 7 in the second position may be near the downstream side of the reference wall 5.

In the present embodiment, description has bee made of a case where the sheet treating apparatus 200 is disposed above the printer main body 100 and the sheets are upwardly transported, but in a case where the sheet treating apparatus 200 is disposed below the printer main body 100 and the sheets are downwardly transported, a similar effect will be obtained if design is made such that the sheets are transported below the sheet delivery lever 7.

A second embodiment of the present invention will now be described.

Figure 9A:
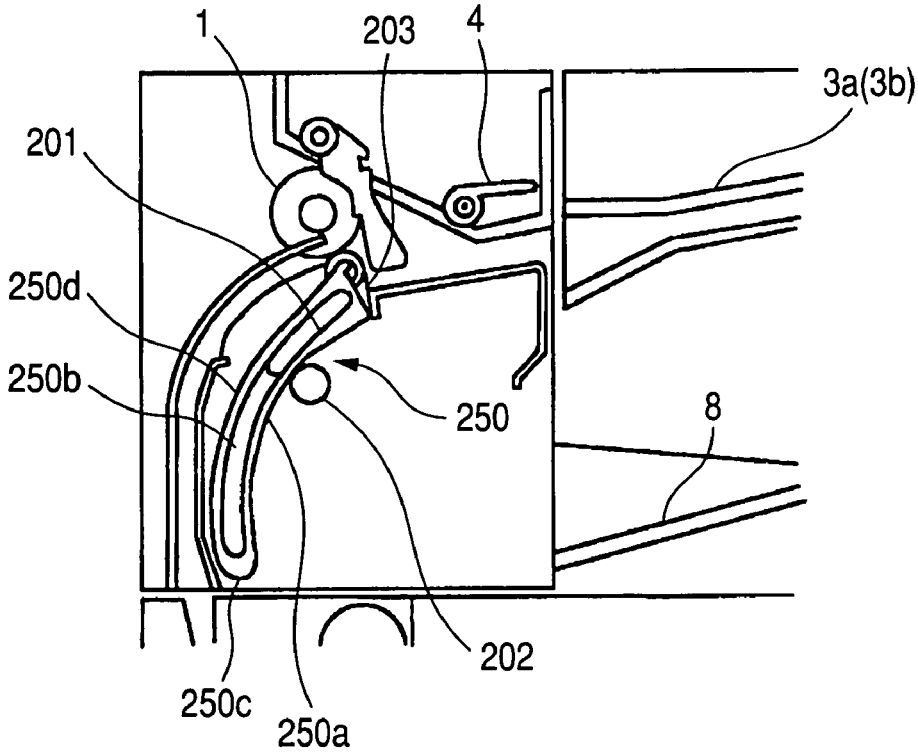
FIGS. 9A and 9B illustrate the construction of a sheet treating apparatus according to a second embodiment of the present invention.
Figure 9B:
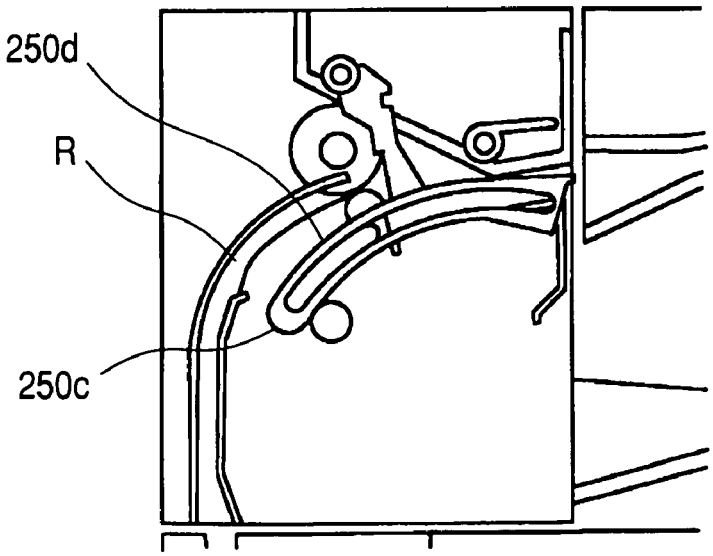

FIGS. 9A and 9B show the construction of a sheet treating apparatus according to the present embodiment. In FIGS. 9A and 9B, the same reference characters as those in FIG. 2 designate the same or corresponding portions.

In FIGS. 9A and 9B, the reference numeral 250 designates a sheet delivery lever, and this sheet delivery lever 250 is formed with an arcuate guide groove 250*b* engaged by a guide 201. The reference numeral 202 denotes a forwardly and reversely rotatable gear, and this gear 202 is in meshing engagement with a rack, not shown, formed on the underside 250*a* of the sheet delivery lever 250.

Thereby, when the gear 202 is rotated by a predetermined amount in the clockwise direction, the sheet delivery lever 250 is moved from a first position shown in FIG. 9A wherein it is retracted into a reference wall 203 to a second position as shown in FIG. 9B wherein it protrudes from the reference wall 203 and can deliver a sheet bundle.

At this time, the upstream end 250*c* of the sheet delivery lever 250 remains retracted to the upstream side of the reference wall 203 as in the first embodiment, whereby the sheet delivery lever 250 can pass by the sheet as in the first embodiment.

Also, in the present embodiment, the upper surface 250*d* of the sheet delivery lever 250 is of an arcuate shape substantially along the curved transport path R as in the first embodiment, and by the upper surface 250*d* of the sheet delivery lever 250 being thus formed, the sheet delivery lever 250 can perform the role of a transport guide for guiding the underside of the sheet transported thereto.

Thus, in the present embodiment, the shape and operation of the sheet delivery lever 250 capable of passing by the sheet as in the first embodiment are realized and yet, driving means for the sheet delivery lever 250 is provided by a rack and a gear, whereby as compared with the driving means in the first embodiment provided by a lever and a cam, the construction of the driving means becomes simple and inexpensive and further, the occupied space in the interior of the apparatus may be small. Also, the fine forward and reverse control by the motor becomes possible, and a broader condition can also be coped with.

A third embodiment of the present invention will now be described.

Figure 10:
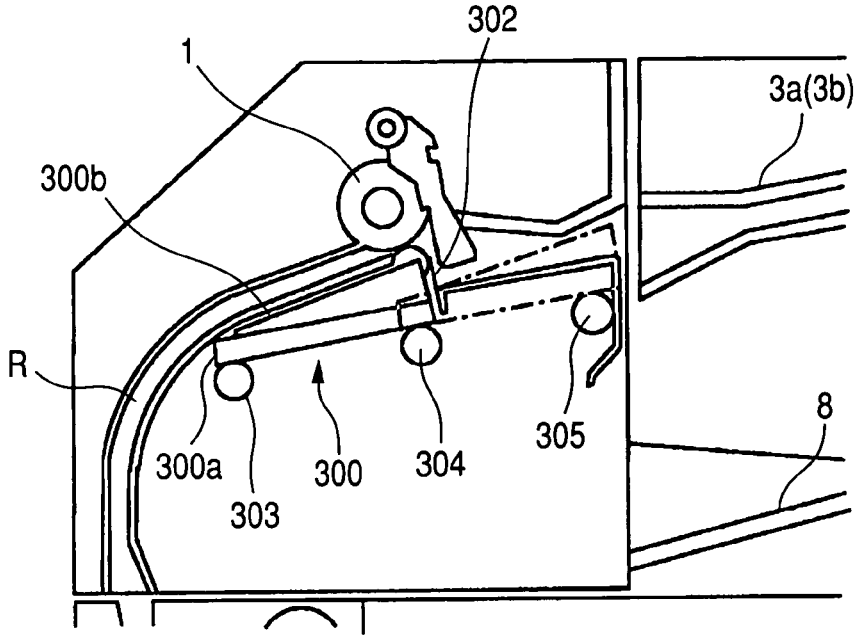
FIG. 10 illustrates the construction of a sheet treating apparatus according to a third embodiment of the present invention.
Figure 11:
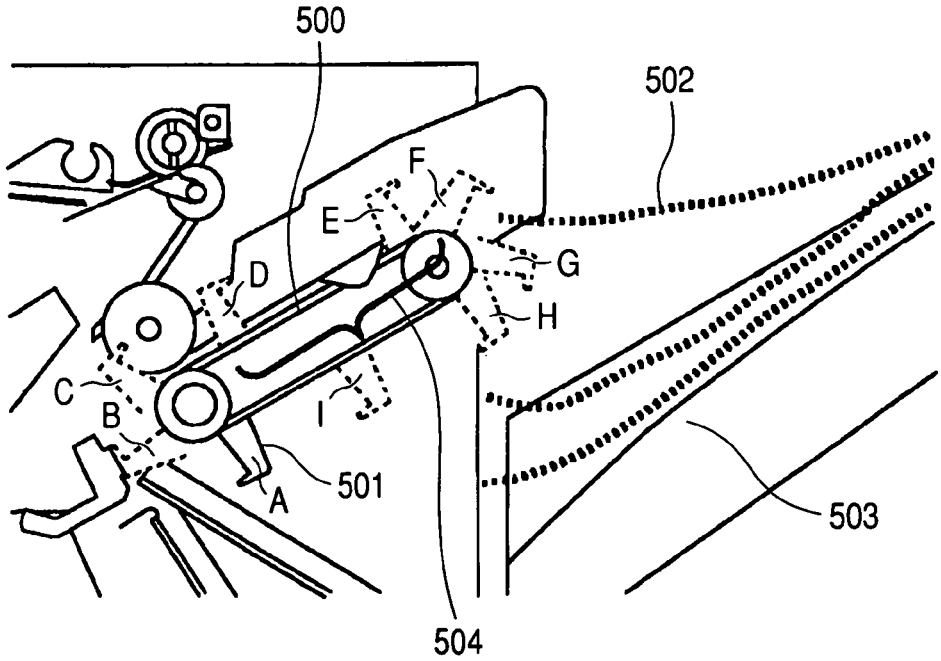
FIG. 11 illustrates the construction of a conventional sheet treating apparatus.

FIG. 10 shows the construction of a sheet treating apparatus according to the present embodiment. In FIG. 10, the same reference characters as those in FIG. 2 designate the same or corresponding portions.

In FIG. 10, the reference numeral 300 designates a sheet delivery lever, and the reference numerals 303 to 305 denote guide rollers which are rotatable members rotated while supporting the sheet delivery lever 300 from below it. A rack, not shown, is formed on the underside of the sheet delivery lever 300, and at least the central guide roller 304 of the three guide rollers 303 to 305 is forwardly and reversely rotatable, and this guide roller 304 is formed with a gear, not shown, meshing with the rack on the underside of the sheet delivery lever 300.

Thereby, when the guide roller 304 is forwardly and reversely rotated, the sheet delivery lever 300 is moved from a first position indicated by solid line in FIG. 10 in which it is retracted into a reference wall 302 to a second position indicated by dot-and-dash line in which it protrudes from the reference wall 302 and can deliver a sheet bundle.

At this time, the upstream end 300*a* of the sheet delivery lever 300 remains retracted to the upstream side of the reference wall 302 as in the first embodiment and the second embodiment, whereby as in the first embodiment and the second embodiment, the sheet delivery lever 300 can pass by the sheet when it is returned from the second position to the first position.

Also, in the present embodiment, the upper surface 300*b* of the sheet delivery lever 300 has a substantially straight line shape along a straight transport path R, and by the upper surface 300*b* of the sheet delivery lever 300 being formed as described above, the sheet delivery lever 300 can perform the role of a transport guide for guiding the underside of the sheet transported thereto.

The present embodiment realizes an effect similar to that of the first embodiment and yet, only requires the smallest occupied space in the interior of the apparatus, as compared with even the second embodiment. Also, the fine forward and reverse control by a motor become possible, and a broader condition can also be coped with.

While in the description hitherto made, a construction in which sheets fed in from the printer main body 100 are intermediately stacked has been described, in the present invention, as already described, the sheet delivery lever (delivering means) can pass by a succeeding sheet and therefore, the operation in a mode wherein for example, the sheet delivery lever delivers each sheet and is returned to its initial position, and repeats the delivering operation for the next sheet to thereby effect the continuous delivery of a single sheet is also possible.

What is claimed is:

1. A sheet treating apparatus for delivering a sheet to a treating tray and treating it, and thereafter delivering the treated sheet onto sheet stacking means, said sheet treating apparatus comprising:

a trailing edge regulating member for contacting with a trailing edge of the sheet delivered to said treating tray with respect to a delivering direction of the sheet, and regulating the trailing edge of the sheet; and delivering means reciprocally movable between a first position in which it is retracted to an upstream side of said trailing edge regulating member with respect to the sheet delivering direction and a second position in which it protrudes into a stacking area of said treating tray, and adapted to push the trailing edge of the sheet on said treating tray to thereby deliver the treated sheet onto said sheet stacking means, wherein when said delivering means is to be moved from said second position to said first position, said delivering means is adapted to be moved to pass by the sheet delivered to said treating tray, and wherein an upper surface of said delivering means constitutes a guide surface for guiding the sheet delivered to said treating tray.

2. A sheet treating apparatus according to claim 1, wherein when said delivering means is in said second position, an upstream side end portion of said delivering means with respect to the sheet delivering direction is positioned on an upstream side of said trailing edge regulating member with respect to the sheet delivering direction.

3. A sheet treating apparatus according to claim 1, further comprising a transport path for transporting the sheet to said treating tray, wherein an upper surface of said delivering means does not protrude to said transport path on the upstream side of said transport path with respect to the sheet delivering direction of said trailing edge regulating member, and is positioned on a substantially extension of said transport path on a downstream side of said transport path with respect to the sheet delivering direction of said trailing edge regulating member, wherein said delivering means is moved along said transport path between said first position and said second position by a rack formed on said delivering means, and a gear meshing with said rack.

4. A sheet treating apparatus according to claim 3, wherein said gear is provided on a rotatable member rotated while supporting said delivering means.

5. A sheet treating apparatus for delivering a sheet to a treating tray and treating it, and thereafter delivering the treated sheet onto sheet stacking means, said sheet treating apparatus comprising:

a trailing edge regulating member for contacting with a trailing edge of the sheet delivered to said treating tray with respect to a delivering direction of the sheet, and regulating the trailing edge of the sheet; and delivering means reciprocally movable between a first position in which it is retracted to an upstream side of said trailing edge regulating member with respect to the sheet delivering direction and a second position in which it protrudes into a stacking area of said treating tray, and adapted to push the trailing edge of the sheet on said treating tray to thereby deliver the treated sheet onto said sheet stacking means, wherein when said delivering means is to be moved from said second position to said first position, said delivering means is adapted to be moved to pass by the sheet delivered to said treating tray; and a transport path for transporting the sheet to said treating tray, wherein an upper surface of said delivering means does not protrude to said transport path on the upstream side of said transport path with respect to the sheet delivering direction of said trailing edge regulating member, and is positioned on a substantially extension of said transport path on a downstream side of said transport path with respect to the sheet delivering direction of said trailing edge regulating member, wherein said delivering means is moved along said transport path between said first position and said second position by cam means.

6. A sheet treating apparatus according to claim 5, wherein the upper surface of said delivering means has a shape substantially parallel to said transport path.

7. An image forming apparatus comprising:

an image forming portion for forming an image on a sheet, and a sheet treating apparatus according to any one of claims 2, 1, 6, 5, 3 or 4 for treating the sheet on which the image has been formed by said image forming portion.

8. A sheet treating apparatus comprising:

a treating tray on which sheets are temporarily stacked, a trailing edge regulating member which contacts with a trailing edge of the sheet delivered to said treating tray with respect to a delivering direction of the sheet, and which regulates the trailing edge of the sheet; and a stacking tray onto which the treated sheets are delivered, a sheet delivery lever reciprocally movable between a first position in which it is retracted to an upstream side of said trailing edge regulating member with respect to the sheet delivering direction and a second position in which it protrudes into a stacking area of said treating tray, and adapted to push the trailing edge of the sheet on said treating tray to thereby deliver the treated sheet onto said sheet stacking tray, wherein when said sheet delivery lever is to be moved from said second position to said first position, said sheet delivery lever is adapted to be moved to pass by the sheet delivered to said treating tray, and wherein an upper surface of said sheet delivery lever constitutes a guide surface for guiding the sheet delivered to said treating tray.

9. A sheet treating apparatus according to claim 8, wherein when said sheet delivery lever is in said second position, an upstream side end portion of said sheet delivery lever with respect to the sheet delivering direction is positioned on an upstream side of said trailing edge regulating member with respect to the sheet delivering direction.

10. A sheet treating apparatus according to claim 8, further comprising:

a transport path for transporting the sheet to said treating tray, wherein an upper surface of said sheet delivery lever does not protrude to said transport path on the upstream side of said transport path with respect to the sheet delivering direction of said trailing edge regulating member, and is positioned on a substantially extension of said transport path on a downstream side of said transport path with respect to the sheet delivering direction of said trailing edge regulating member, wherein said sheet delivery lever is moved along said transport path between said first position and said second position by a rack formed on said sheet delivery lever, and a gear meshing with said rack.

11. A sheet treating apparatus according to claim 10, wherein said gear is provided on a rotatable member rotated while supporting said sheet delivery lever.

12. A sheet treating apparatus comprising:

a treating tray on which sheets are temporarily stacked, a trailing edge regulating member which contacts with a trailing edge of the sheet delivered to said treating tray with respect to a delivering direction of the sheet, and which regulates the trailing edge of the sheet; and a stacking tray onto which the treated sheets are delivered, a sheet delivery lever reciprocally movable between a first position in which it is retracted to an upstream side of said trailing edge regulating member with respect to the sheet delivering direction and a second position in which it protrudes into a stacking area of said treating tray, and adapted to push the trailing edge of the sheet on said treating tray to thereby deliver the treated sheet onto said sheet stacking tray, wherein when said sheet delivery lever is to be moved from said second position to said first position, said sheet delivery lever is adapted to be moved to pass by the sheet delivered to said treating tray; and a transport path for transporting the sheet to said treating tray, wherein an upper surface of said sheet delivery lever does not protrude to said transport path on the upstream side of said transport path with respect to the sheet delivering direction of said trailing edge regulating member, and is positioned on a substantially extension of said transport path on a downstream side of said transport path with respect to the sheet delivering direction of said trailing edge regulating member, wherein said sheet delivery lever is moved along said transport path between said first position and said second position by cam means.

13. A sheet treating apparatus according to claim 12, wherein the upper surface of said sheet delivery lever has a shape substantially parallel to said transport path.

14. An image forming apparatus comprising:

an image forming portion for forming an image on a sheet, and a sheet treating apparatus according to any one of claims 9, 8, 13, 12, 10 or 11 which treats the sheets on which the image has been formed by said image forming portion.

* * * * *

UNITED STATES PATENT AND TRADEMARK OFFICE

CERTIFICATE OF CORRECTION

PATENT NO. : 7,237,774 B2
APPLICATION NO. : 10/824421
DATED : July 3, 2007
INVENTOR(S) : Masayoshi Fukatsu et al.

It is certified that error appears in the above-identified patent and that said Letters Patent is hereby corrected as shown below:

COLUMN 4:
Line 6, "adapted" should read --adapted to--.

COLUMN 10:
Line 20, "substantially" should read --substantial--.
Line 57, "substantially" should read --substantial--.

COLUMN 11:
Line 4, "2, 1, 6, 5, 3 or 4" should read --1 to 6--.
Line 42, "substantially" should read --substantial--.

COLUMN 12:
Line 30, "substantially" should read --substantial--.
Line 45, "9, 8, 13, 12, 10 or 11" should read --8 to 13--.

Signed and Sealed this

Twentieth Day of May, 2008

JON W. DUDAS
*Director of the United States Patent and Trademark Office*